US005218157A

United States Patent [19]

Akagawa et al.

[11] Patent Number: 5,218,157

[45] Date of Patent: Jun. 8, 1993

[54] AUTO-ACCOMPANIMENT INSTRUMENT DEVELOPING CHORD SEQUENCE BASED ON INVERSION VARIATIONS

[75] Inventors: Noboru Akagawa; Junichi Takano, both of Hamamatsu, Japan

[73] Assignee: Kabushiki Kaisha Kawai Gakki Seisakusho, Shizuoka, Japan

[21] Appl. No.: 921,649

[22] Filed: Jul. 30, 1992

[30] Foreign Application Priority Data

Aug. 1, 1991 [JP] Japan ..... 3-215797

[51] Int. Cl.[5] ..... G10H 1/38

[52] U.S. Cl. ..... 84/637; 84/DIG. 22

[58] Field of Search ..... 84/613, 637, DIG. 22

[56] References Cited

U.S. PATENT DOCUMENTS 4,656,911 4/1987 Sakurai ..... 84/DIG. 22

FOREIGN PATENT DOCUMENTS 63-80299 11/1988 Japan .

137758 9/1989 Japan .

*Primary Examiner*—Stanley J. Witkowski

[57] ABSTRACT

An auto-accompaniment apparatus, which selects and forms a chord that can be naturally linked with currently generated chord tones from a plurality of inversion variations, and generates the formed chord as the next accompaniment tones, is disclosed.

The auto-accompaniment apparatus has an accompaniment pattern memory (1) for storing note data strings for performing an auto chord accompaniment operation on the basis of reference chords, and offset memories (3, 5) for storing tone pitch offsets of the note data with respect to the reference chord in units of chord notes of different chord names in correspondence with a plurality of chord inversion variations and root names. The plurality of offsets corresponding to the chord inversion variations are read out from the offset memories on the basis of a pre-programmed chord progression sequence or chord information detected based on play information. Of the readout offsets, an offset close to the currently generated chord tones is selected by a selector (31). The note data from the accompaniment pattern memory (1) are modified using the selected offset, and the modified data are output to a tone generator (16) as accompaniment information.

8 Claims, 5 Drawing Sheets

AUTO-ACCOMPANIMENT INSTRUMENT DEVELOPING CHORD SEQUENCE BASED ON INVERSION VARIATIONS

BACKGROUND OF THE INVENTION

1. Field of the Invention

The present invention relates to an auto-accompaniment apparatus for, e.g., an electronic musical instrument.

2. Description of the Related Art

In an auto-accompaniment apparatus in a known electronic musical instrument, chord type data (major, minor, seventh, or the like, and chord root data (C, D, E, . . .) are detected from information of a key depression operation, and chord data (chord tone data) necessary for an accompaniment operation are generated on the basis of the above data with referring to prestored accompaniment pattern data (formed with reference to, e.g., C major).

Accompaniment pattern data consists of a string of note data constituting a chord, and each note data consists of several bytes indicating a tone pitch (key number), a tone generation timing, a tone generation duration, a tone volume, and the like. The accompaniment pattern data are prepared in units of types of rhythms, and are repetitively read out from a ROM at a tempo designated in correspondence with a selected rhythm.

The ROM stores tone pitch difference values (offsets) in units of chord types (major, minor, and seventh) with respect to reference chords belonging to, e.g., C major in the form of a look-up table.

Chord type data and chord root data are detected from key operation information input by a player. The tone pitch difference value corresponding to the detected chord type data is read out from the ROM. The difference value and a root value are added to key scale numbers representing notes programmed as the accompaniment pattern to be read out from the ROM, thereby obtaining key number data of chord tones to be generated. A tone source unit generates accompaniment tones on the basis of the modified key numbers, and tone generation duration data and tone volume data of chord notes read out from the ROM.

The conventional auto-accompaniment apparatus has only one development method which uses a look-up table for development from reference chords to chord tones corresponding to chord types instructed by a player. For this reason, when chords are changed, the tone pitches of accompaniment tones abruptly leap, resulting in an unnatural play.

For example, when a chord is changed from C7 to G7, notes (C, E, G, Bb) are abruptly changed to (G, B, D, F), i.e., all the tones abruptly become higher by perfect fifth.

SUMMARY OF THE INVENTION

It is an object of the present invention to provide an auto-accompaniment apparatus, which can make an auto-accompaniment operation with natural chord development in consideration of the above-mentioned problem.

An auto-accompaniment apparatus of the present invention comprises accompaniment pattern memory means for storing note data strings for performing an auto chord accompaniment operation on the basis of reference chords, offset memory means for storing tone pitch offset values of the note data with respect to the reference chords in units of chord notes of different chord names in correspondence with a plurality of chord inversion variations, chord progression memory means for storing a chord progression sequence, selection means for reading out a plurality of offsets corresponding to the chord inversion variations on the basis of chord name information sequentially read out from the chord progression memory means, and selecting an offset close to the currently generated chord, and modification means for modifying the note data from the accompaniment pattern memory means using the selected offset, and outputting the modified note data as play information to tone source means.

An auto-accompaniment apparatus according to another characteristic feature of the present invention comprises accompaniment pattern memory means for storing note data strings for performing an auto chord accompaniment operation on the basis of reference chords, offset memory means for storing tone pitch offset values of the note data with respect to the reference chords in units of chord notes of different chord names in correspondence with a plurality of chord inversion variations, chord name detection means for detecting chord names in a play operation from key operation information, selection means for reading out a plurality of offsets corresponding to the chord inversion variations on the basis of chord name information sequentially detected by the chord name detection means, and selecting an offset close to the currently generated chord, and modification means for modifying the note data from the accompaniment pattern memory means using the selected offset, and outputting the modified note data as play information to tone source means.

Pre-programmed auto-accompaniment note data are automatically developed according to chord information obtained during a play operation or a chord progression pattern pre-programmed on the basis of reference chords, thereby generating accompaniment tones. The chord development method is not limited to one pre-programmed fixed method, and inversion variations that can be naturally connected to currently generated chord tones are automatically selected. Therefore, the tone pitches can be prevented from leaping before and after a change in chord upon chord progression, and a natural auto-accompaniment operation can be realized.

DETAILED DESCRIPTION OF THE PREFERRED EMBODIMENT

Figure 1:
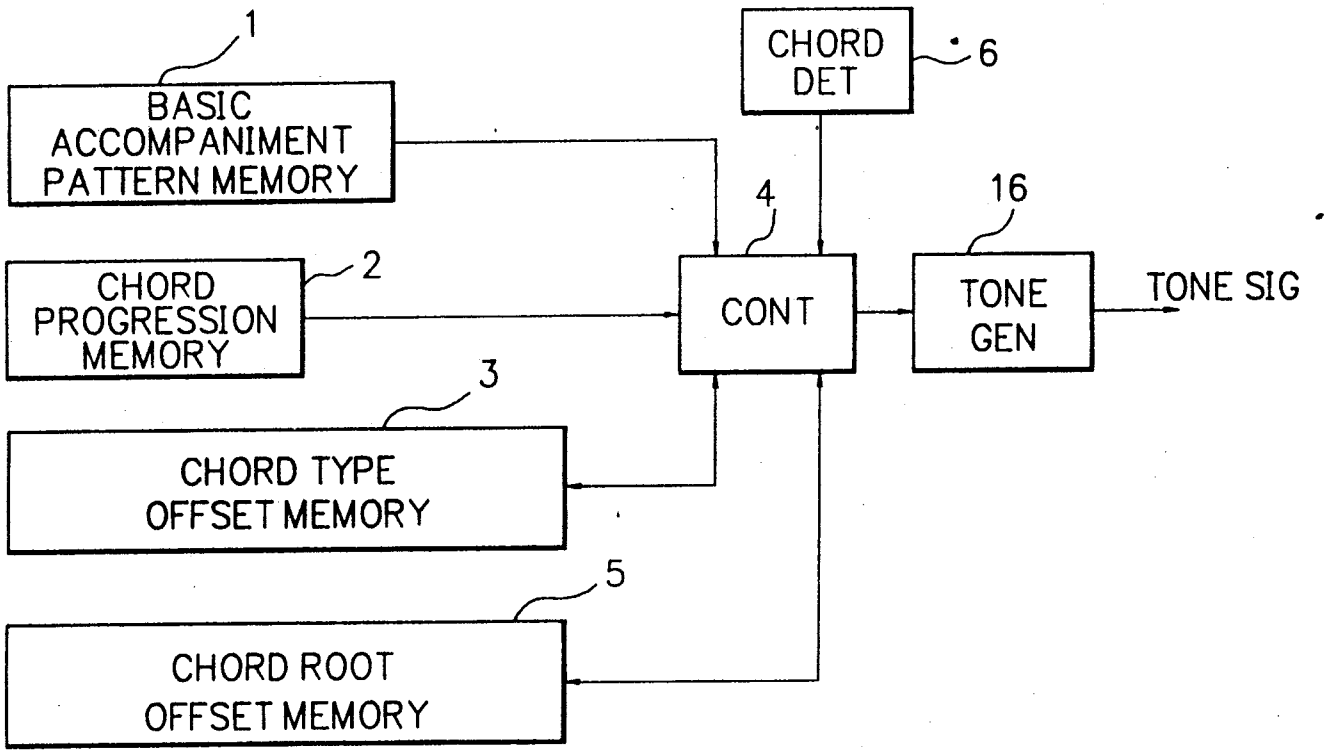
FIG. 1 is a block diagram showing elemental features of an auto-accompaniment apparatus according to the present invention.
Figure 2:
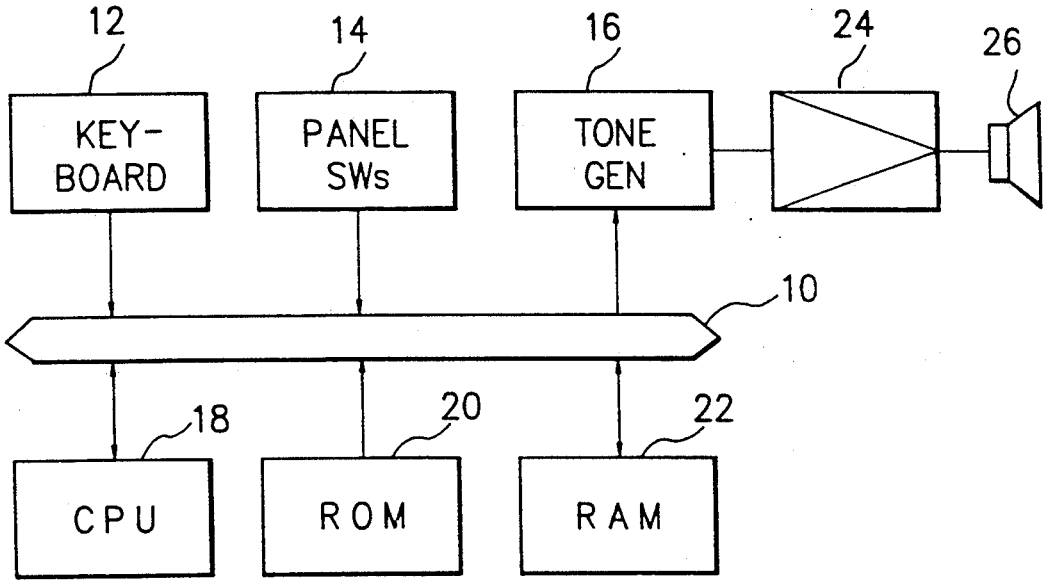
FIG. 2 is a block diagram showing the overall arrangement of an electronic musical instrument, which is assembled with the auto-accompaniment apparatus shown in FIG. 1.

FIG. 1 shows the fundamental arrangement of an auto-accompaniment apparatus according to an embodiment of the present invention, and FIG. 2 shows the overall arrangement of an electronic musical instrument, which is assembled with the auto-accompaniment apparatus of this embodiment.

In the electronic musical instrument of this embodiment, accompaniment tones such as melody tones, chord tones, rhythm tones, and the like are generated under the control of a microcomputer.

A bus 10 is connected to a keyboard 12, panel switches 14, a tone generator 16, a CPU 18, a program/-data ROM 20, and a RAM 22. When a player operates the keyboard 12, the CPU 18 detects a key number, a key depression velocity, and the like on the basis of a key scan program written in the ROM 20, and outputs corresponding tone control data to the tone generator 16. The tone generator 16 reads out tone source data from a waveform ROM (not shown) on the basis of the key number designated at the keyboard, and an instrument type, a rhythm type, and the like set using the panel switches 14, processes the envelope, duration, and the like of the readout waveform, and then converts the waveform data into an analog signal. The tone generator 16 then outputs the analog signal to an amplifier 24. An audio signal output from the amplifier 24 is supplied to a loudspeaker 26, thus forming a melody play tone.

The CPU 18 performs chord development of an accompaniment pattern on the basis of chord progression pattern data written in units of rhythms in the ROM, while reading out auto-accompaniment pattern data (written in, e.g., C major seventh) written in the ROM 20 at a given tempo speed. The developed chord information is supplied to the tone generator 16 to form corresponding accompaniment tone signals on the basis of tone source data in the waveform ROM, and the tone signals are supplied to the loudspeaker 26 through the amplifier 24.

Note that in place of using the chord progression pattern data in the ROM 20, chord type data (major, minor, seventh, and the like) and chord root data (C, D, E, . . .) necessary for chord development may be detected on the basis of play information obtained from the keyboard 12 so as to modify auto-accompaniment pattern data.

The technique for detecting accompaniment chord type and chord root data from key play information is disclosed in, e.g., Japanese Patent Publication No. 1-37758, Japanese Laid-Open Patent Application No. 63-80299, and the like. The ROM 20 is written with a program for detecting chord type and chord root data, a program for modifying accompaniment pattern data with the chord type and chord root data to generate accompaniment chord data, and modification data.

In the fundamental arrangement shown in FIG. 1, a basic accompaniment pattern memory 1 stores two-bar accompaniment information (note data consisting of a tone pitch, tone volume, tone duration, and tone generation timing of each tone) constituted by three parts, i.e., drum note, bass note, and chord note parts. Chord tones are programmed by only chord notes (C, E, G, and B) of Cmaj7 (C major seventh). Note that the accompaniment information is stored in units of rhythm types.

A chord progression memory 2 stores a chord progression sequence (a series of chord names such as C →Am→F→$G_7$→C, and chord change timings) for establishing a simple repetition of basic accompaniment patterns as a music piece, and auto-play control information (stop and repeat of a play, and their timings). The chord progression memory 2 may be replaced with a chord detector 6 connected to the keyboard 12. A chord type offset memory 3 stores chord notes of major seventh chords in units of chord types, and offsets with respect to chord notes belonging to a scale that can be used by the major seventh chords. More specifically, the memory 2 stores offsets of four different inversion variations of the chord part, and offsets of the bass part in correspondence with each chord type. For example, Table 1 below shows the offsets of seventh chords in the chord part.

TABLE 1

| | Offsets of Seventh Chords | | | |
|---|---|---|---|---|
| Maj7 | (1) | (2) | (3) | (4) |
| (C) | 0 (C) | +7 (G) | −2 (B♭) | +4 (E) |
| (E) | 0 (E) | +6 (B♭) | −4 (C) | +3 (G) |
| (G) | 0 (G) | +5 (C) | −3 (E) | +3 (B♭) |
| (B) | −1 (B♭) | +5 (E) | −4 (G) | +1 (C) |

(Chord names in parentheses are those when root=C)

A controller 4 manages timings, and checks the chord change timings of the chord progression memory 2, and the tone generation timings of the basic accompaniment pattern memory 1.

A chord root offset memory 5 stores tone pitch differences as offsets from roots of the reference chords in units of chord roots.

Figure 3:
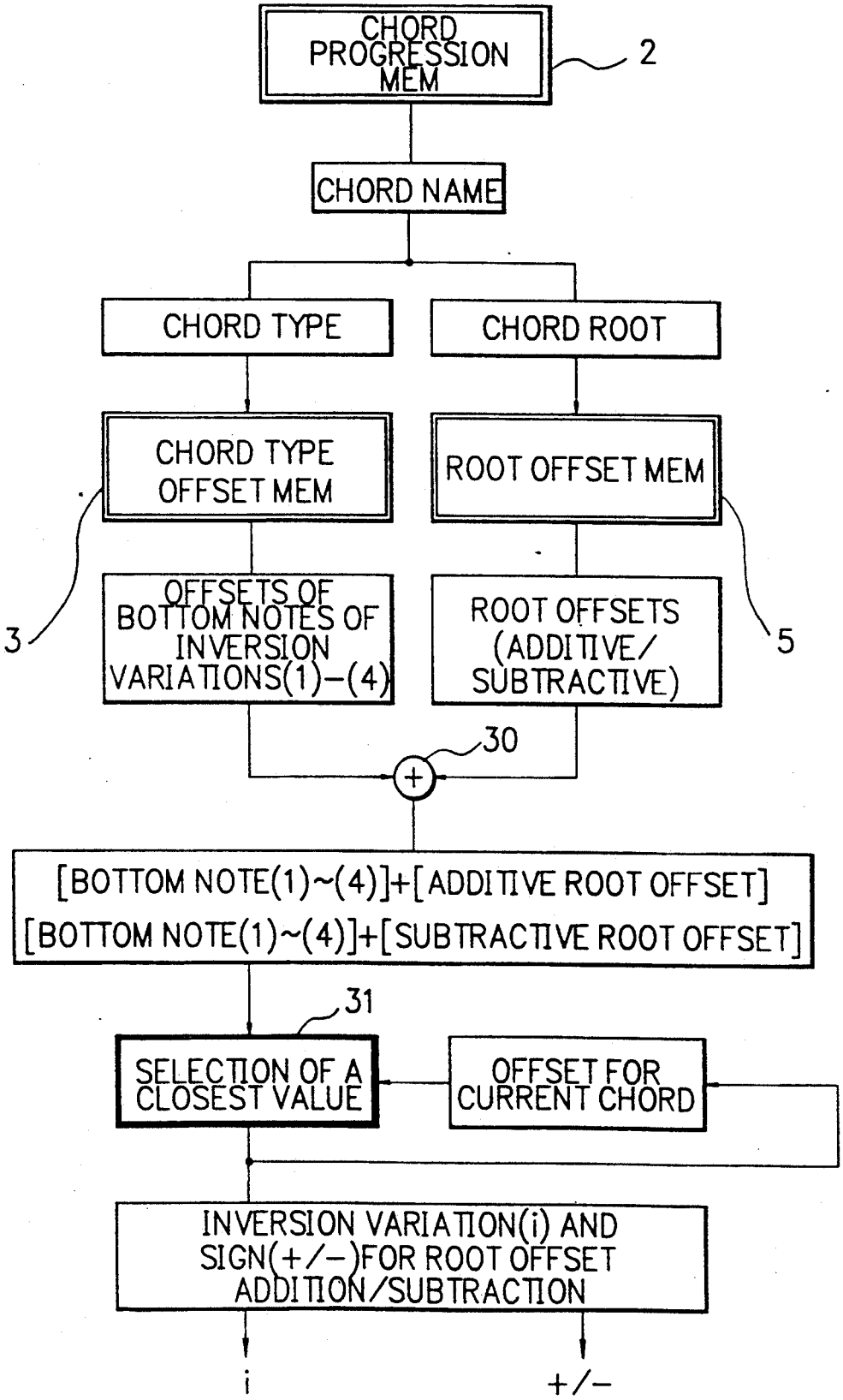
FIG. 3 is a flow chart showing a chord development data processing sequence.
Figure 4:
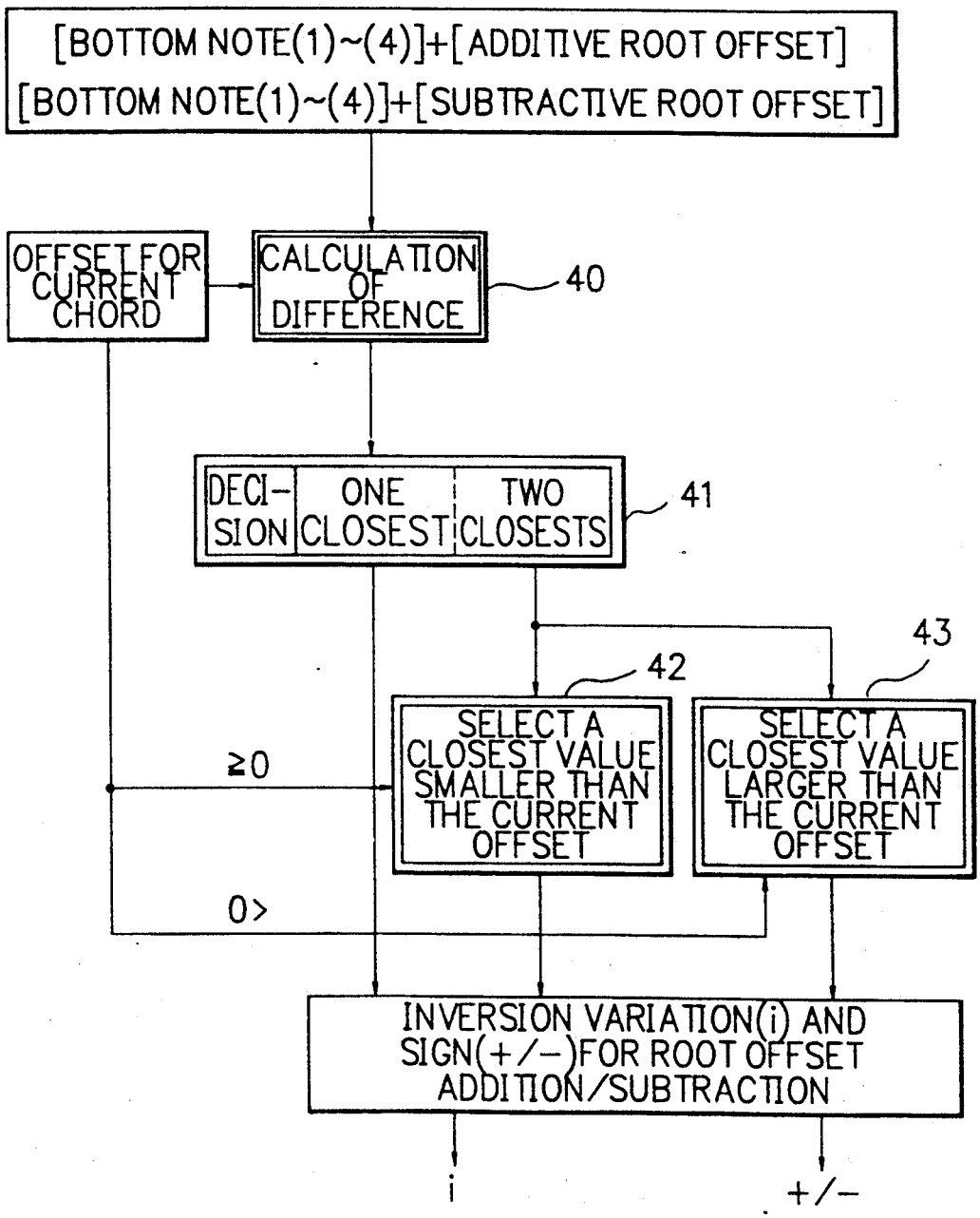
FIG. 4 is a flow chart showing the chord development data processing sequence.
Figure 5:
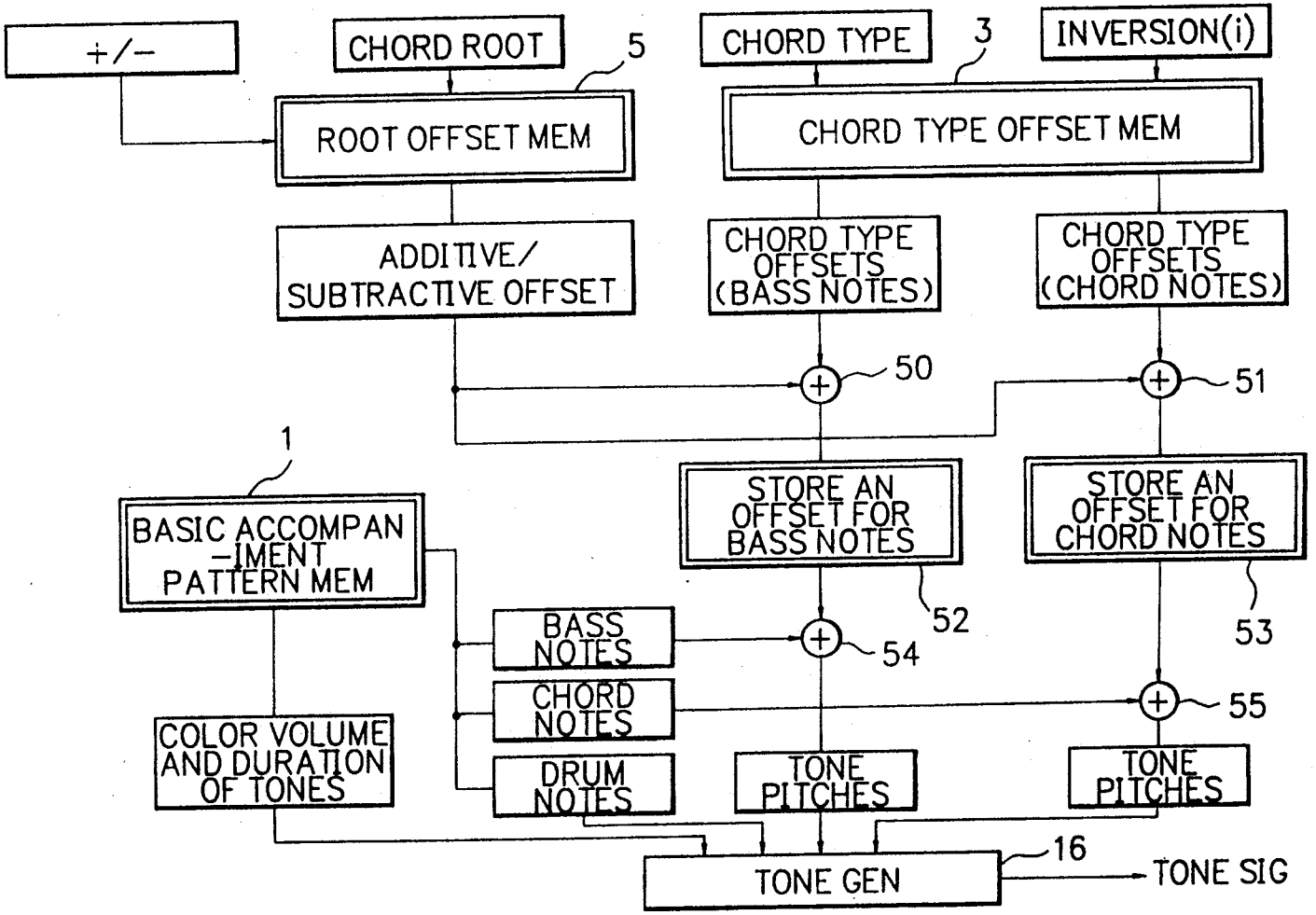
FIG. 5 is a flow chart showing the chord development data processing sequence.

FIGS. 3, 4, and 5 are flow charts showing processing data flows in the controller 4 shown in FIG. 2. In FIGS. 3, 4, and 5, double-line blocks indicate arithmetic processing in the CPU 18, and read/write processing of the ROM 20 and the RAM 22, and single-line blocks indicate data contents to be processed.

In FIG. 3, a series of chord name data are sequentially read out from the chord progression memory 2 in the ROM 20 at each chord change timing and at a tempo speed corresponding to a selected rhythm. The chord name data consists of chord type data (major, minor, seventh, and the like), and chord root data.

The chord type data is supplied to the chord type offset memory 3 in the ROM 20 as address information, and all the offsets of bottom tones (lowest tones) of the four different inversion variations shown in Table 1 are read out in correspondence with the chord type data.

On the other hand, the chord root data is supplied to the chord root offset memory 5 in the ROM 20 as address information, and the offsets corresponding to the chord root are read out. When the basic accompaniment pattern is formed based on Cmaj7, the offsets corresponding to roots are as shown in Table 2 below.

TABLE 2

| | Offsets Corresponding to Chord | |
|---|---|---|
| Roots | Additive | Subtractive |
| C | 0 | 0 |
| C♯/D♭ | 1 | −11 |
| D | 2 | −10 |
| D♯/E♭ | 3 | −9 |
| E | 4 | −8 |
| F | 5 | −7 |
| F♯/G♭ | 6 | −6 |
| G | 7 | −5 |
| G♯/A♭ | 8 | −4 |
| A | 9 | −3 |
| A♯/B♭ | 10 | −2 |
| B | 11 | −1 |

As shown in Table 2, two series of root offsets, i.e., additives and subtractives are prepared. The additive is an upper note side offset, and the subtractive is a lower note side offset, and the difference therebetween is one octave.

The offsets of bottom notes of the invention variations (1) to (4), and the root offsets (additive and subtractive) read out in correspondence with the chord type and chord root data are added to each other in step 30 of addition processing, thus generating four different additive offsets [bottom tones (1) to (4)]+ [additive root offset] and four different subtractive offsets [bottom tones (1) to (4)]+[subtractive root offset].

In step 31, an offset closest to (having the smallest difference from) the offset of the currently generated chord tones is selected from the additive and subtractive offsets. As selection results, information i for designating one of the four different inversion variations, and a sign +/− for designating one of addition/subtraction are obtained. Of the calculated offsets, offsets lower than the lowest note in a bottom tone range, and those higher than the highest note in the range are excluded from objects to be selected.

FIG. 4 is a flow chart showing the details of a selection algorithm in step 31. In step 40, differences between the current offset and the eight additive and subtractive offsets are calculated. If it is determined in step 41 that there is only one offset having the smallest difference, the inversion variation information i and the addition/subtraction sign +/− corresponding to the offset are output for the next chord development.

If it is determined in step 41 that there are two offsets having the smallest difference, one of these offsets is selected in step 42 or 43. More specifically, an offset closest to the offset of the currently generated chord at the higher note side, and an offset closest to the current offset at the lower note side may have the same tone pitch difference. In this case, when the current offset is larger than 0, the closest offset at the lower note side is selected in step 42; when the current offset is equal to or smaller than 0, the closet offset at the higher note side is selected in step 43. Thus, as the selection results, the inversion variation information i and the addition/subtraction sign +/− are obtained.

FIG. 5 shows a chord development sequence. The inversion variation information i of the offset selected in step 31 in FIG. 3, and the next chord type information read out from the chord progression memory 2 are supplied as address information to the chord type offset memory 3, thereby reading out offsets for bass and chord notes, respectively.

On the other hand, the chord root information read out from the chord progression memory 2 and the addition/subtraction sign +/− obtained upon selection in step 31 are supplied as address information to the root offset memory 5, and one of an additive and subtractive offsets corresponding to the chord root is read out.

The offsets read out from the chord type offset memory 3 and the chord root offset memory 5 are added to each other in addition steps 50 and 51, and are stored in registers as bass and chord note offsets for generating the next accompaniment tones in steps 52 and 53.

The controller 4 (FIG. 1) monitors tone generation note data in the basic accompaniment pattern memory 1, and every time the tone generation timing is reached, the controller 4 outputs the note data of accompaniment tones. When the note data represent drum notes, tone pitches in the note data are written in the tone generator 16 as tone generation parameters without modifications.

When the readout note data represent bass or chord notes, the offset values of the notes stored in the registers are added to the tone pitches (key codes) of the note data (steps 54 and 55), and the sum data are written in the tone generator 16 as tone generation parameters, i.e., tone pitches of the developed chord.

The tone colors, tone volumes, and tone durations of note data read out from the basic accompaniment pattern memory 1 are written in the tone generator 16 as tone generation parameters without modifications. The tone generator 16 reads out PCM waveform data from the waveform ROM on the basis of the set tone generation parameters, and outputs tone signals for generating tones after it processes the tone volumes, tone durations, and the like.

As described above, chords can be naturally and automatically changed in consideration of a connection between adjacent chords on the basis of chord progression information. In a normal music play, it is not musically preferable that chords progress while their tone pitches leap, since it results in uneasy feeling in terms of a flow of play. For this reason, in general, a player forms a natural code progression with a smooth change using inversion variations having small tone pitch motions. In the above-mentioned offset selection algorithm, such a method normally used by a player is applied to an auto-play apparatus, and is simulated by programming of the controller 4.

For example, in a conventional apparatus, when a chord is changed from C7 to G7, notes (C, E, G, Bb) are abruptly changed to (G, B, D, F), i.e., all the tones abruptly become higher by perfect fifth. However, according to the above-mentioned chord automatic development, chord notes can be changed from (C, E, G, Bb) to (B, D, F, G) to have a relatively small tone pitch difference.

As for an auto-play music piece programmed in the ROM, inversion variations can be manually designated without automatically selecting inversion variations, thus attaining further natural chord progression throughout the music piece in place of a connection between two adjacent chords. In contrast to this, the tone pitches designated by a player may be intensively caused to leap so as to emphasize a chord change operation. In this case, in step 31 of selecting the closest offset, an offset having a predetermined tone pitch difference or more is selected.

According to the present invention, when auto-accompaniment note data pre-programmed based on reference chords are developed according to a chord name obtained during a play operation or a pre-programmed chord progression pattern, a chord that can be naturally connected to the currently generated chord can be selected and generated from a plurality of inversion variations. Therefore, the tone pitches can be prevented from unnaturally leaping before and after chords are changed upon chord progression, and natural auto-accompaniment tones can be obtained.

What is claimed is:

1. An auto-accompaniment apparatus comprising:

accompaniment pattern memory means for storing note data strings for performing an auto chord accompaniment operation on the basis of reference chords;

offset memory means for storing tone pitch offset values of the note data with respect to the reference chords in units of chord notes of different chord names in correspondence with a plurality of chord inversion variations;

chord progression memory means for storing a chord progression sequence;

selection means for reading out a plurality of offsets corresponding to the chord inversion variations on the basis of chord name information sequentially read out from said chord progression memory means, and selecting an offset close to the currently generated chord; and modification means for modifying the note data from said accompaniment pattern memory means using the selected offset, and outputting the modified note data as play information to tone source means.

2. An apparatus according to claim 1, wherein the chord name consists of chord type information and chord root information, said offset memory means comprises:

chord type offset memory means for storing tone pitch offsets in units of different chord types in correspondence with the plurality of chord inversion variations; and chord root offset memory means for storing tone pitch offsets with respect to roots of the reference chords in units of different roots, and said selection means selects the offset close to the currently generated chord from the offsets of the inversion variations, each of which is expressed by a sum of chord type and chord root offsets.

3. An apparatus according to claim 2, wherein said chord root offset memory means stores higher and lower note side offsets having an octave difference therebetween in units of different roots, and said selection means selects the offset close to the currently generated chord from sums of the offsets corresponding to the plurality of inversion variations, and higher and lower note side offsets having the octave difference therebetween.

4. An apparatus according to claim 3, wherein when the higher and lower note side offsets having equal pitch differences from the current offset used for developing the currently generated chord are present in the offsets to be selected, said selection means selects the lower note side offset when the current offset is positive, and said selection means selects the higher note side offset when the current offset is negative.

5. An auto-accompaniment apparatus comprising:

accompaniment pattern memory means for storing note data strings for performing an auto chord accompaniment operation on the basis of reference chords;

offset memory means for storing tone pitch offset values of the note data with respect to the reference chords in units of chord notes of different chord names in correspondence with a plurality of chord inversion variations;

chord name detection means for detecting chord names in a play operation from key operation information;

selection means for reading out a plurality of offsets corresponding to the chord inversion variations on the basis of chord name information sequentially detected by said chord name detection means, and selecting an offset close to the currently generated chord; and modification means for modifying the note data from said accompaniment pattern memory means using the selected offset, and outputting the modified note data as play information to tone source means.

6. An apparatus according to claim 5, wherein the chord name consists of chord type information and chord root information, said offset memory means comprises:

chord type offset memory means for storing tone pitch offsets in units of different chord types in correspondence with the plurality of chord inversion variations; and chord root offset memory means for storing tone pitch offsets with respect to roots of the reference chords in units of different roots, and said selection means selects the offset close to the currently generated chord from the offsets of the inversion variations, each of which is expressed by a sum of chord type and chord root offsets.

7. An apparatus according to claim 6, wherein said chord root offset memory means stores higher and lower note side offsets having an octave difference therebetween in units of different roots, and said selection means selects the offset close to the currently generated chord from sums of the offsets corresponding to the plurality of inversion variations, and higher and lower note side offsets having the octave difference therebetween.

8. An apparatus according to claim 7, wherein when the higher and lower note side offsets having equal pitch differences from the current offset used for developing the currently generated chord are present in the offsets to be selected, said selection means selects the lower note side offset when the current offset is positive, and said selection means selects the higher note side offset when the current offset is negative.

* * * * *